US006321457B1

(12) United States Patent
Lariviere, Jr. et al.

(10) Patent No.: US 6,321,457 B1
(45) **Date of Patent: *Nov. 27, 2001**

(54) CUTTING TEMPLATE AND METHOD OF USING SAME

(76) Inventors: Richard L. Lariviere, Jr.; D. Marie Lariviere, both of 17 Jay's La., Hanover, MA (US) 02339

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/256,866

(22) Filed: Feb. 24, 1999

(51) Int. Cl.[7] ..... B43L 13/20
(52) U.S. Cl. ..... 33/562; 33/563
(58) Field of Search ..... 33/1 F, 1 G, 562, 33/563, 565, 566; 434/87

(56) References Cited

U.S. PATENT DOCUMENTS

| | | | | |
|---|---|---|---|---|
| D. 167,043 | * | 6/1952 | Kintz | 33/563 |
| 1,879,624 | * | 9/1932 | Lockwood | 33/563 |
| 2,334,913 | * | 11/1943 | Eisenberg | 33/566 |
| 2,586,039 | | 2/1952 | Heggedal | 40/125 |
| 3,364,598 | | 1/1968 | Cook | 35/26 |
| 3,574,017 | | 4/1971 | Kass | 156/63 |
| 4,230,164 | * | 10/1980 | Mericle | 33/562 |
| 4,586,714 | | 5/1986 | Lenkoff et al. | 273/157 |
| 5,511,316 | * | 4/1996 | Fischer et al. | 33/562 |
| 5,865,928 | | 2/1999 | Lariviere et al. | 156/256 |

OTHER PUBLICATIONS

*Tool & Die Journal*, p. 184, Jan. 1945 (classified in 33/563), see left.*

* cited by examiner

*Primary Examiner*—G. Bradley Bennett
(74) *Attorney, Agent, or Firm*—Morriss, Bateman, O'Bryant & Compagni

(57) ABSTRACT

A cutting template for use in cutting a geometric shape or pattern, such as an oval, of any size, into or out of a selected medium. A preferred embodiment configured according to the invention includes a transparent or translucent sheet with two or more grooves therein that generally define a selected geometric pattern, and additional grooves in the sheet define one or more similar patterns that differ in size, with the several different size patterns being arranged in a nested relationship. The grooves serve as guide channels for a cutting instrument that extends directly through the channels into cutting relation with an underlying medium, thereby eliminating any need for separately tracing the desired pattern onto the medium. Different embodiments of the invention have sets of grooves which define different shapes.

12 Claims, 8 Drawing Sheets

CUTTING TEMPLATE AND METHOD OF USING SAME

BACKGROUND OF THE INVENTION

1. Field of the Invention

The invention relates to cutting material into selected shapes. More specifically, the invention relates to templates for guiding a cutting instrument for cutting selected materials so as to produce selected shapes.

2. Discussion of Related Art

Many hobbies and professions involve sizing or shaping materials or apertures therein. For example, preparing photographs for display typically includes mounting a photograph on a substrate, and then overlying the photograph with a mat having a shaped aperture so that the mat frames and enhances the photograph. Conversely the mat can be mounted under the photograph and the photograph mounted on the mat, with the protruding beyond the edges of the photograph to obtain a similar look.

Cutting a shaped aperture in a medium is accomplished in many different ways. For example, a shape may be drawn on the medium and subsequently traced with a cutting tool. The shape also may be drawn on a separate piece of material which is then cut out and applied to the medium to be cut. An appropriately sized and shaped aperture or mat also may be located on material according to a template having appropriate apertures which may be traced and subsequently incised. Also to avoid the inconvenience of maintaining a collection of templates having different aperture shapes and sizes, some templates may provide interchangeable modules. See, for example, U.S. Pat. No. 5,531,176, issued Jul. 2, 1996, to A. M. Johnson, U.S. Pat. No. 5,860,219, issued Jan. 19, 1999, to C. E. Wilkinson, and U.S. Pat. No. 5,613,811, issued Mar. 25, 1997, to G. M. Tillemans.

The use of a template for use as a cutting guide is not new. For example, U.S. Pat. No. 5,865,928, issued Feb. 2, 1999, to R. L. Lariviere, Jr. et al, describes custom cutting photographs and other graphic materials into interlocking puzzle shapes to construct a collage-puzzle. The template disclosed by Lariviere et al. has channels which guide a blade so as to cut a desired medium, such as a photograph into puzzle pieces of different predetermined shapes.

Unfortunately, the foregoing teachings do not provide for creating similar shapes, silhouettes, rings, borders or windows in or from a selected material in multiple sizes. In this connection it should be noted that a circular- or star-shaped border, for example, placed around a photograph on a page of a photograph album serves to distinguish the photograph. Prior to the invention, obtaining such borders in different sizes would require drawing a multiple of different size circle or star outlines by hand on a selected material, or tracing them on the selected material using a plurality of templates each having a different size outline of the desired shape, and then cutting along the material along the specific traced outline. Alternatively, a template with the desired size outline or pattern could be placed on top of the selected material and then the latter cut directly according to the outline without any intervening tracing step. Such procedures are time-consuming and/or lack precision. What is needed to facilitate the cutting process is a cutting template for cutting selected medium into a selected pattern that affords the choice of a plurality of like patterns that differ in size.

None of the aforementioned references, taken alone or in combination, are seen as teaching or suggesting the present claimed cutting template or the method of using same.

SUMMARY OF THE INVENTION

The invention provides a cutting template of novel design for use in cutting a selected medium in sheet form so as to create a selected pattern or shape, such as an oval, circle, star, or rectangle, of a selected size. The invention also provides a method of using such templates so as to cut selected shapes in a selected medium. The template may be used to cut out solid pieces of selected shapes for mounting on a separate substrate. Alternatively it may be used to cut the medium so as to provide rings, e.g., oval or star-shaped rings, for use as borders. The template also may be used to cut an aperture in a medium so as to convert the medium into a framing mat for a photograph, print or other graphic arts object. In the preferred embodiment of the invention the template comprises a plurality of cutting channels or grooves that define a plurality of like patterns that differ in size and are nested in concentric relation to one another, whereby one template can be used as a cutting guide for cutting out a plurality of pieces having similar shapes but different sizes. Templates with nested (i.e., concentric) patterns offer the advantage that only a few templates are required for cutting a selected medium so as to provide a relatively large number of patterns of diverse shapes and sizes. The templates are preferably made of a transparent plastic material which allows for observing the medium during placement of the template thereon and during cutting of the medium. The invention provides optimal cutting grooves that guide a cutting blade so as to assure precision cutting.

Other features and advantages of the invention are described in or rendered obvious by the following detailed description and the drawings referred to therein.

BRIEF DESCRIPTION OF THE DRAWINGS

The invention is described in detail below with reference to the following drawings, throughout which similar reference characters denote corresponding features consistently, wherein:

FIG. 8 is graphical illustration of a solid shape generated by a template configured according to the invention; and.

In the drawings, like numerals designate like components or features.

DETAILED DESCRIPTION OF THE INVENTION

The invention provides cutting templates for precisely cutting a selected medium in sheet form so as to produce similar shapes in multiple sizes, or diverse shapes. The nature of the medium that is used may vary according to the intended purpose. By way or example, the medium may take the form of a sheet of paper or cardboard or conventional graphic arts matting material or thin plastic foam or a fabric. The medium may be white or colored and may be blank or printed, comprising, for example, a graphic arts object such as a photograph, print, drawing, or printed text. In practicing the invention, it is preferred that the medium be mounted or placed on a cutting surface, such as sheet of cardboard or plastic foam, a template embodying the invention is placed flat on top of the medium. Thereafter thin cutting blade of a cutting tool is inserted in a groove of the template and then moved along the groove so as to cut the medium to form a shape conforming to the pattern defined by the groove in the template.

Figure 1:
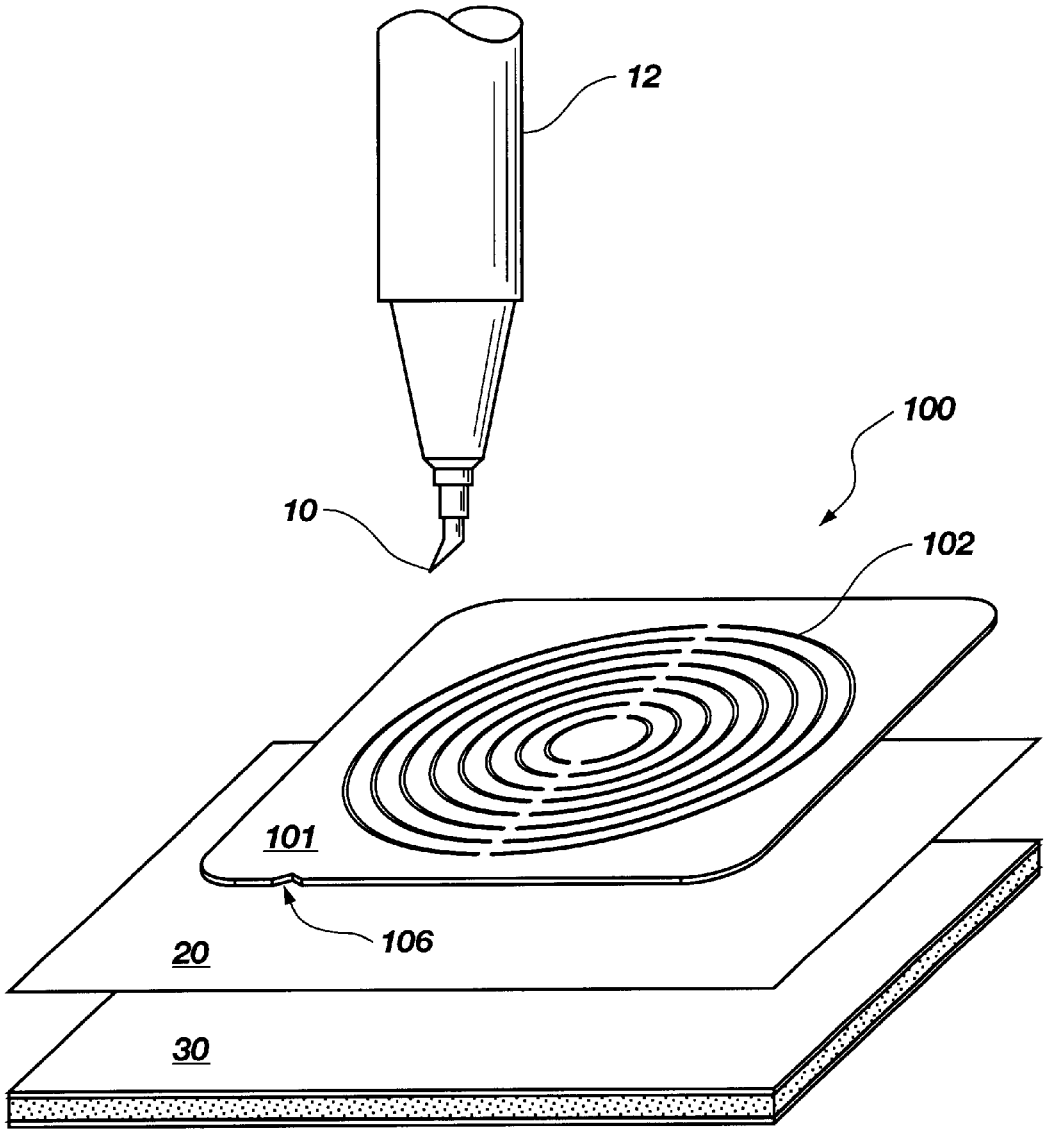
FIG. 1 is an exploded perspective view of illustrating use of one form of template configured according to the invention, the template being shown in relation to other elements involved in practicing the invention.
Figure 2:
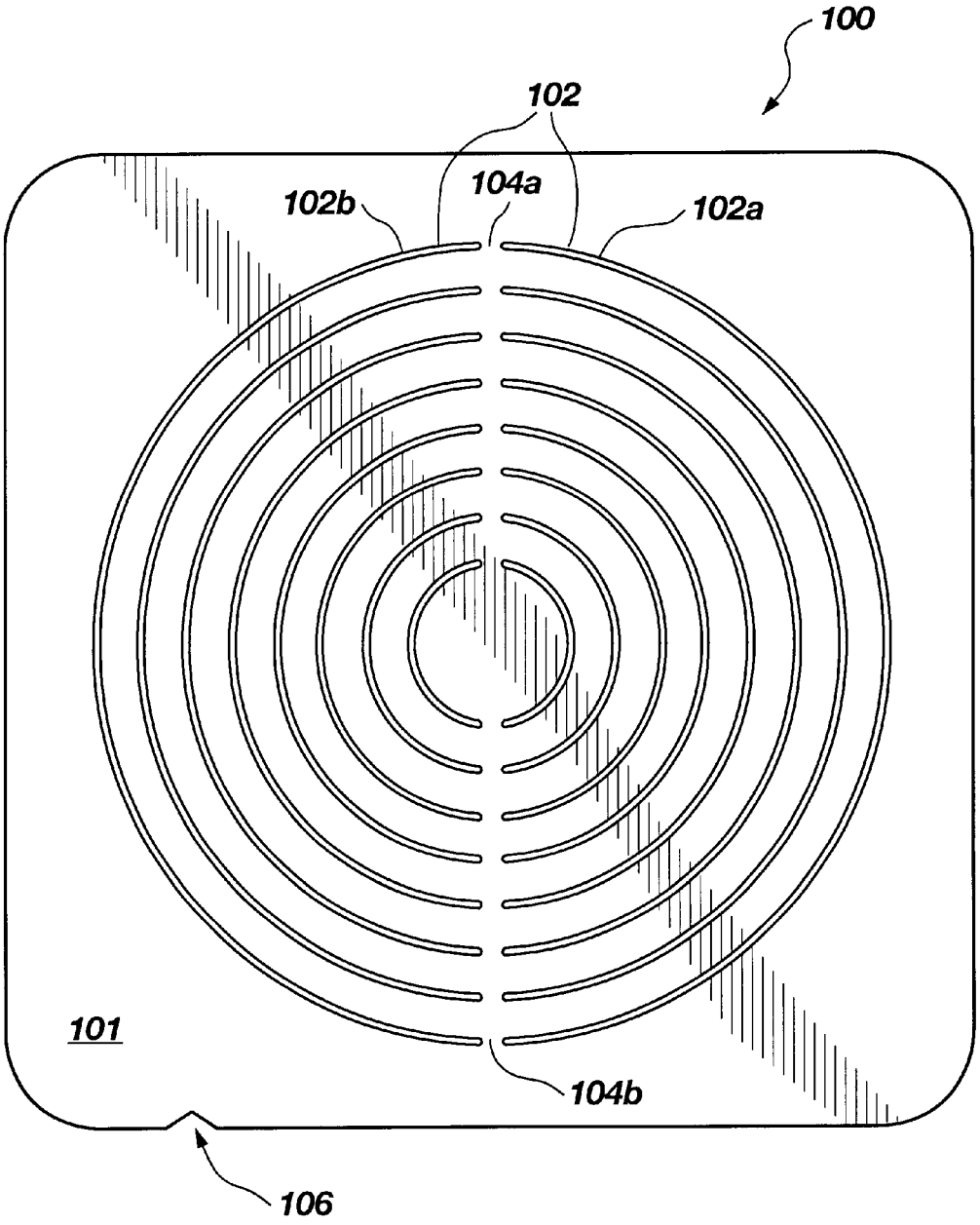
FIGS. 2–7 are plan views of different embodiments of templates configured according to the invention.

Referring to FIGS. 1 and 2, there is shown one form of template 100 configured according to the invention. The template consists of a sheet or panel 101 that preferably is made of a transparent material, although it also may be made of a translucent material. The transparency or translucency of the sheet 101 allows for viewing and/or aligning a selected medium 20 prior to cutting it with a selected cutting tool 12 as hereinafter described. As noted above, the medium is in sheet form and may be white or colored and may be blank or printed, comprising, for example, a graphic arts object such as a photograph, print, drawing, or printed text.

The template 100 is intended to be reusable. Therefore, by way of example but not limitation, it is preferred that the template be constructed from a material that is relatively inexpensive, resists wear, and which allows cutting or formation of the channels hereinafter described. Preferably the template is made a polycarbonate or a polyacrylate material, although a polyethylene template having adequate transparency also may be used.

The specific template 100 shown in FIGS. 1 and 2 comprises a plurality of concentric cutting channels or grooves identified collectively by the numeral 102 that have widths sized to accept the thin cutting blade 10 of cutting tool 12 so that the blade makes a close sliding fit in whatever channel it is inserted. The cutting tool preferably is constructed so that thin cutting blade 10 is rotatable on the cutting tool's axis, as explained in said U.S. Pat. No. 5,865,928

As seen in FIG. 2, the cutting channels 102 in template 100 constitute multiple pairs of elongate openings or grooves 102*a* and 102*b* that cooperate to define a plurality of similar but different size patterns. In the particular template illustrated in FIGS. 1 and 2, the channels are circularly shaped so as to define a plurality of interrupted circles. More specifically, each pair of cooperating grooves 102*a* and 102*b* is separated by two webs 104*a* and 104*b* of template material. Each pair of webs 104*a* and 104*b* and the corresponding pair of grooves 102*a* and 102*b* together define a complete circle. If the cutting blade 10 is drawn along a selected pair of grooves 102*a* and 102*b,* it will make two incisions in medium 20 that are replications of the grooves 102*a* and 102*b,* and the medium will have uninterrupted portions separating those incisions that correspond to template webs 104*a* and 104*b.* Consequently, to complete formation of a circular incision in medium 20, the user must remove the template from engagement with the medium, and then cut the uninterrupted portions of the medium between the two incisions that correspond to webs 104*a* and 104*b* so that the two incisions are joined and define a complete circle.

The width of the template webs 104*a* and 104*b* are set so that the webs have sufficient expanse to maintain the template's physical integrity, while at the same time minimizing the amount of medium that has to be cut after removal of the template to completely reproduce the selected circular pattern or shape in the medium.

The cutting grooves in the template are intended to guide the cutting blade 10 so as to ensure that the patterns defined by the cutting channels will be reproduced with precision in the selected medium 20. In this regard the term "guide" is intended to mean that opposite sides of the cutting blade lie close to and are slidingly supported by the opposite side surfaces of the grooves that constitute the several cutting channels. To ensure proper guidance, it is preferred that the grooves be formed with flat opposite side surfaces that extend perpendicular to the flat faces of template panel 101, and that they have a width such as to provide a clearance in the range of 0.002 and 0.007 inch between each side of the channel and the adjacent face of the inserted knife blade. It is preferred that the cutting blade have a thickness in the range of 0.011 inch to 0.013 inch. Consequently it is preferred that the cutting channels have a thickness of 0.015 inch to 0.018 inch. However, it should be appreciated that cutting blade thickness, the widths of the grooves and the magnitude of the clearances for the cutting blade are not limited to the foregoing values, but rather other values may be acceptable so long as they assure precision cutting of a selected pattern in medium 20.

Referring again to FIG. 1, to use the template 100 for cutting shapes in a medium, it is preferred, but not necessary, that the medium 20 be mounted on a suitable cutting surface 30. Preferably but not necessarily, the medium is attached to the cutting surface with pins or adhesive, tape or by other known means (not shown). Various materials may be used as the cutting surface, e.g., a sheet of polyethylene foam or cardboard or a sheet of particle board. Next, the template 100 is mounted over medium 20. The template may simply rest on the medium. Alternatively it may be secured in place, e.g., by adhesive tape coupling it to the medium or to the cutting surface. The template 100 may be provided with one or more notches 106 for use in properly locating the template in relation to the medium 20 or for use in securing it in place, e.g., by means of a thumb tack. Once the template 100 is properly mounted on the medium 20, the user introduces the cutting blade 10 into a selected one of the grooves 102*a* and 102*b,* and then draws the blade along that groove to begin cutting the medium 20 so as to provide an incision in the medium that is a reproduction of the cutting groove's pattern. Thereafter the user conducts a second cutting procedure by drawing the cutting blade along cutting groove 102*b.* Then, if the user desires only to cut out a solid circular piece from the medium, the user removes the template and proceeds to use the same (or a different) cutting tool to sever those portions of the medium corresponding to webs 104*a* and 104*b* that connect the two incisions, thereby freeing the cut circular piece from the medium. The cut piece may then be used as desired, e.g., mounted on a suitable support for decorative purposes or to form part of collage.

Figure 3:
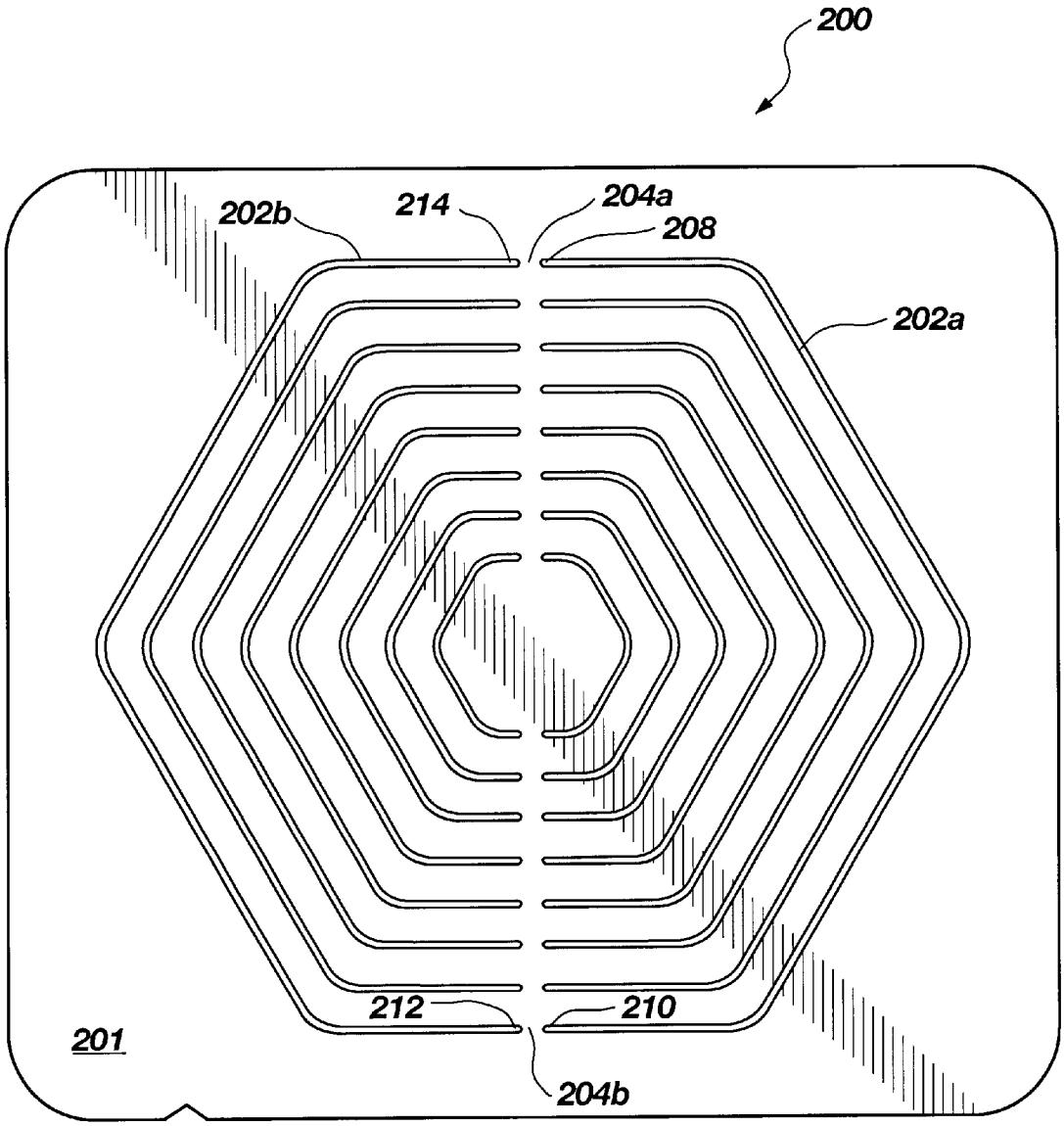
Figure 8:
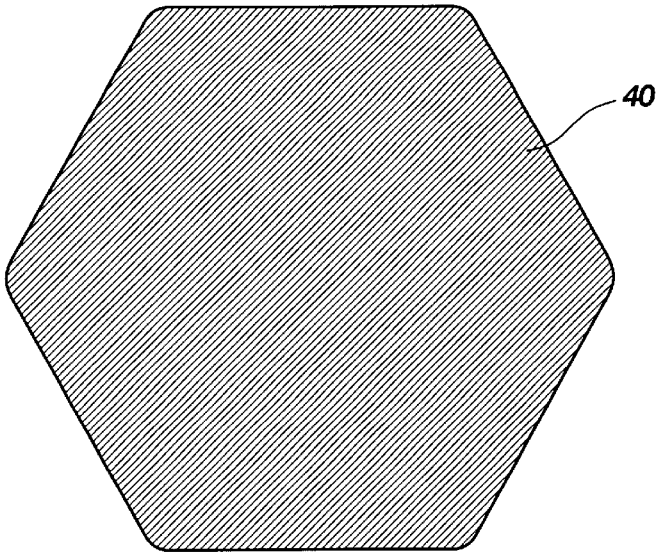

FIG. 3 shows a template 200 that is configured for cutting hexagonal patterns. This template comprises a sheet 201 with a plurality of pairs of matching grooves 202*a* and 202*b,* each groove defining one half of a hexagonal pattern. The grooves are separated by web portions 204A and 204B. This template is used in substantially the same manner as template 110 to make hexagonal incisions in medium 20. More specifically, this is accomplished by mounting template 200 on a selected medium 20 which is itself mounted as described above, and then inserting the cutting blade 10 into a first groove 203A and drawing it along that groove so as to make a through-cut in the medium which corresponds in length to that groove. Then the user repeats the cutting procedure using groove 203B as a guide. After completing those cutting steps, the user removes template 200 from the medium 20 and the medium 20 from the cutting surface 30. At this point the medium has two semi-hexagonal incisions therein, with the grooves separated from one another by a pair of connecting webs or spans corresponding to webs 204A and 204B. Thereafter the user severs the connecting webs in the medium, using the same or a different cutting blade, thereby separating from the medium a solid piece 40 having an hexagonal shape as shown in FIG. 8. It should be noted also that the cutting operation also generates an hexagonal aperture in medium 20. Consequently, if desired, the medium minus the removed piece 40 may be used to frame an image.

Figure 4:
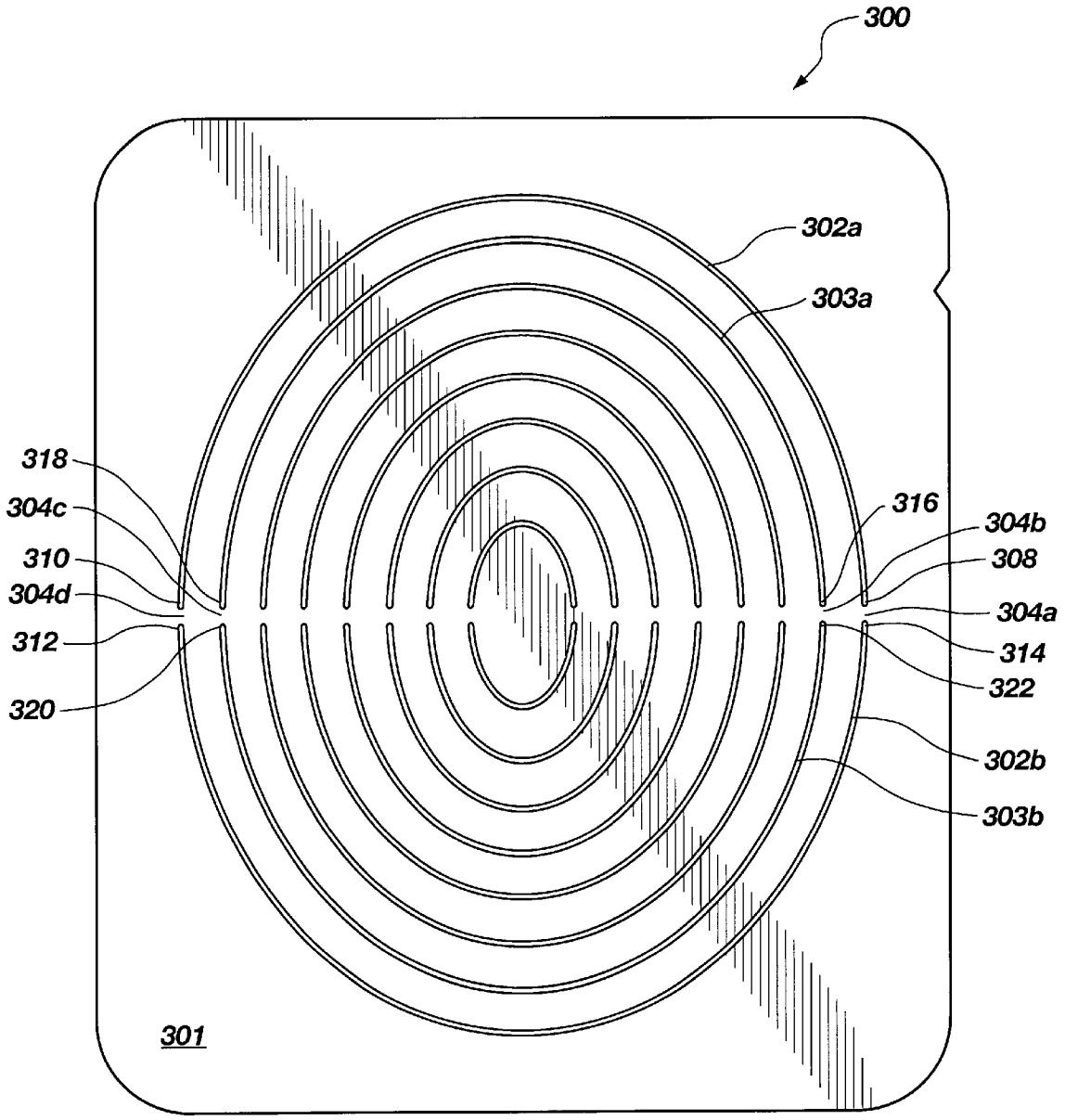
Figure 5:
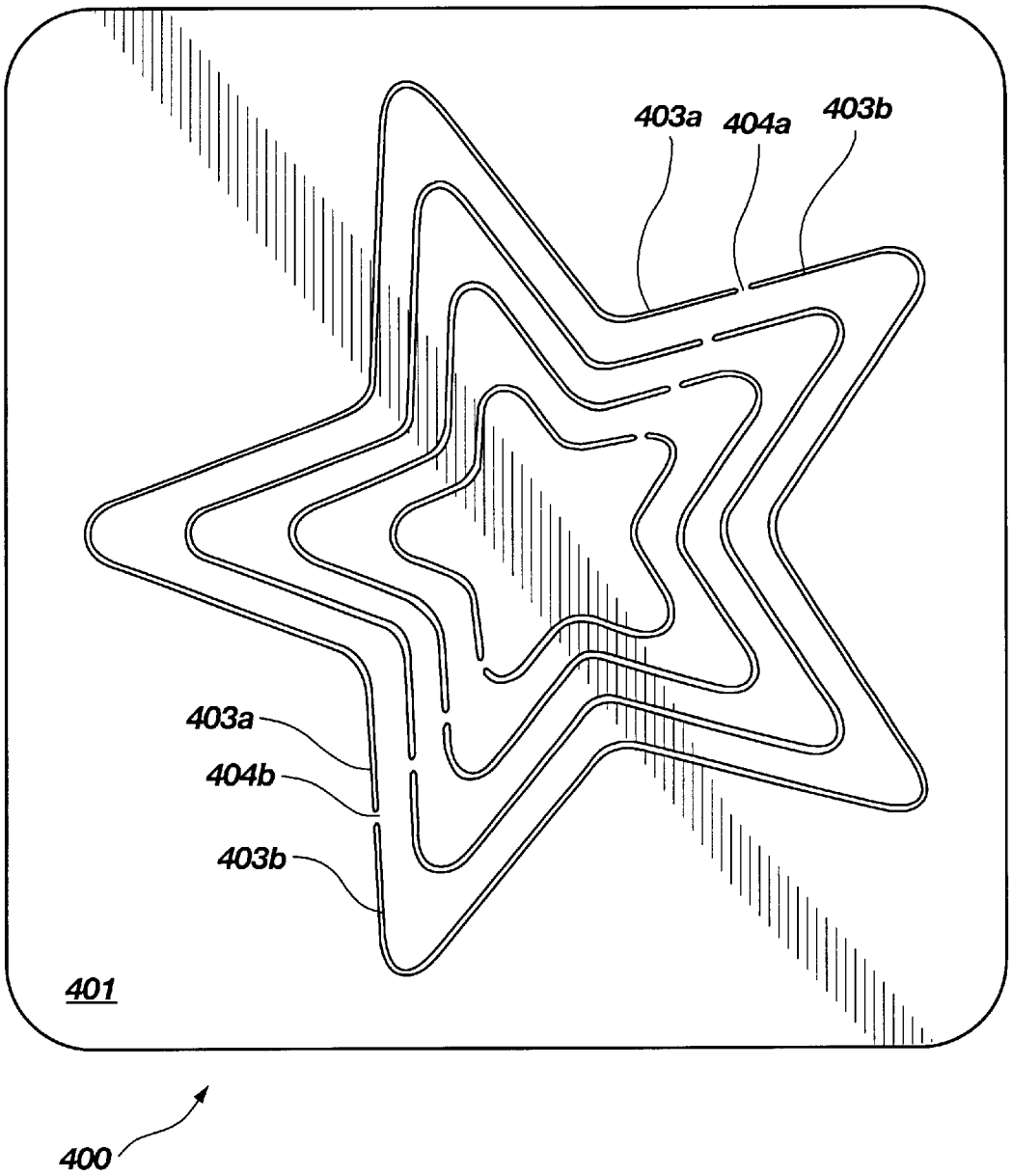
Figure 6:
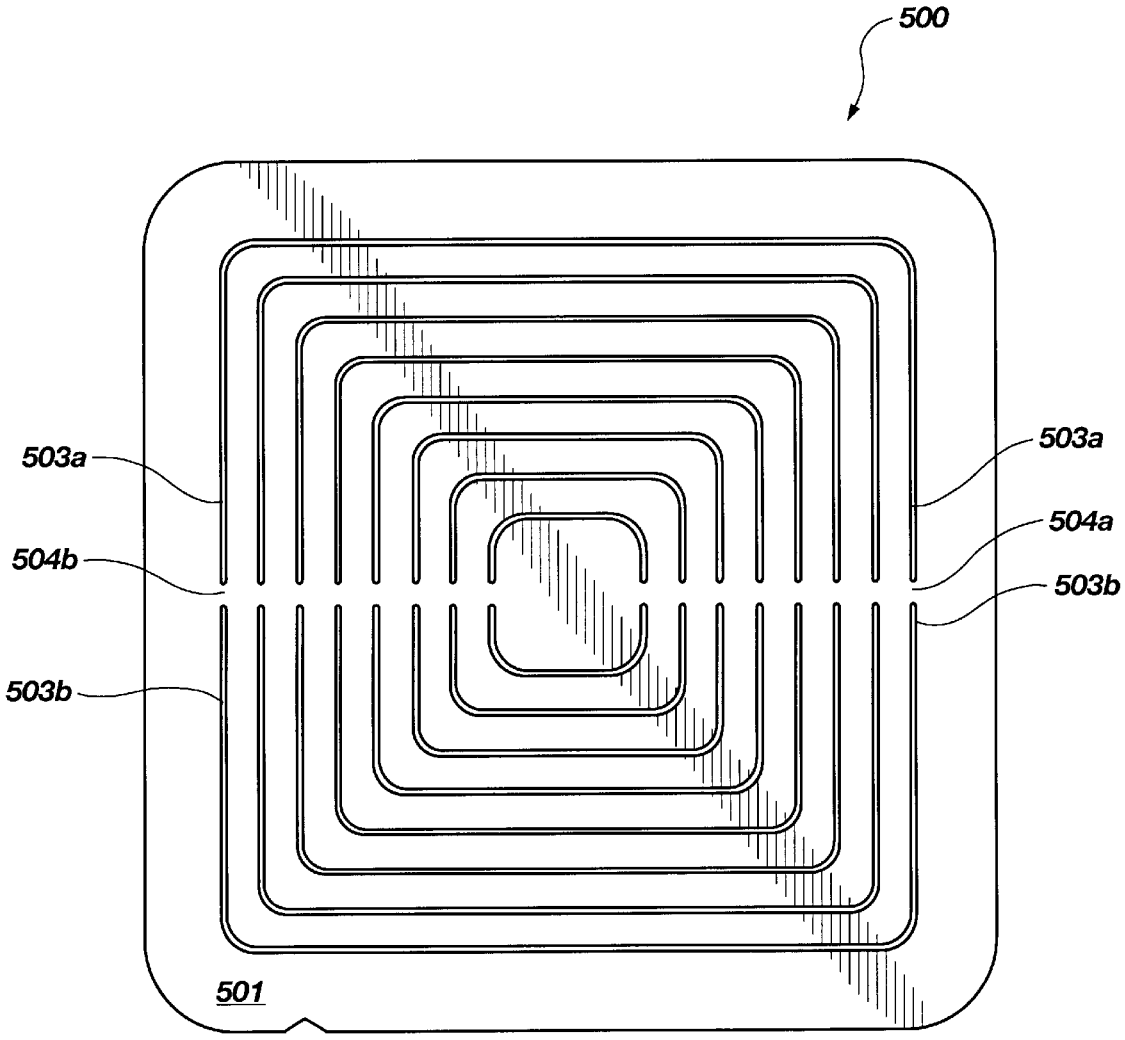

FIGS. 4–6 illustrate examples of other templates made according to the invention. The template 300 includes a sheet 301 having a plurality of pairs of grooves 303A and 303B that coact to define generally a plurality of oval patterns. Each groove 303A is separated from each corresponding groove 303B by two diametrically opposite webs 304A and 304B. By using template 300 in the same manner as described above for templates 100 and 200, it is possible to generate similar oval shapes in different sizes.

Figure 7:
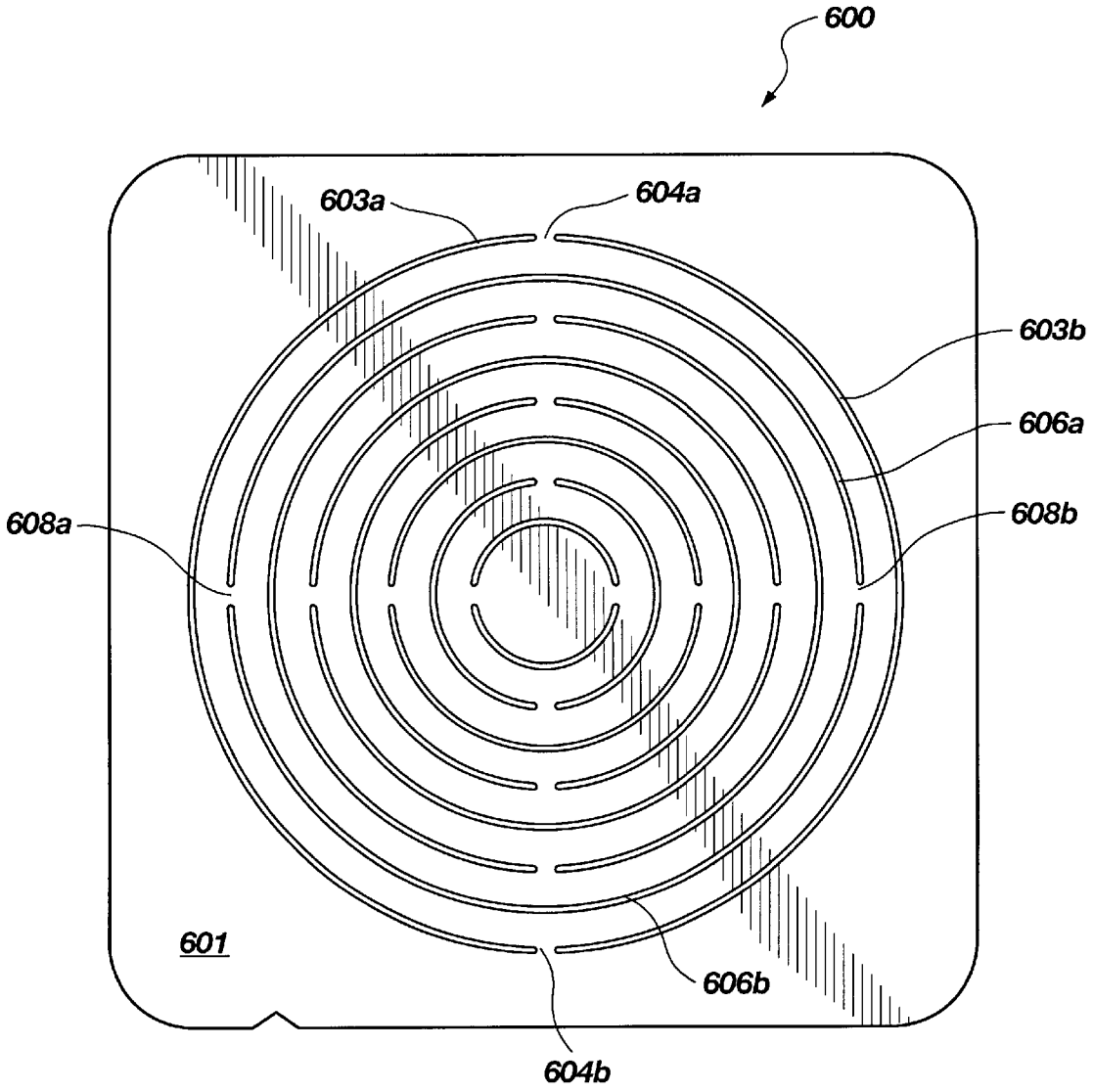

The template 400, shown in FIG. 5 includes a sheet 401 with a plurality of pairs of grooves 403A and 403B that enable a user to cut out pieces in the form of a star. Webs 404A and 404B separate adjacent grooves. The template 500, shown in FIG. 6 includes a sheet 501 with grooves 503A and 503B that enable a user to cut out solid rectangular pieces from a selected medium. Webs 504A and 504B separate adjacent grooves It is to be appreciated that although in each of the templates shown in FIGS. 2–6 each geometric pattern is defined by two grooves, with the webs separating each pair of grooves being aligned radially with corresponding webs associated with all of the other pairs of grooves, it is feasible to arrange the grooves so that the intervening webs are not all aligned with one another. This alternative is illustrated in FIG. 7 where a template 600 for cutting circular patterns comprises a sheet 601 having a plurality of pairs of grooves 603A and 603B, with webs 604A and 604B separating the grooves in each pair. In this case, however, certain of the grooves are arranged so that their webs are aligned horizontally (as viewed in FIG. 7), while the others are arranged so that their webs are aligned vertically. It is contemplated that the webs may also be located in other arrangements and/or be more numerous. However, the radially aligned web configuration characterizing the templates of FIGS. 2–6 is preferred since it is the easiest and least costly to produce and provides the greatest structural integrity to the templates.

Figure 9:
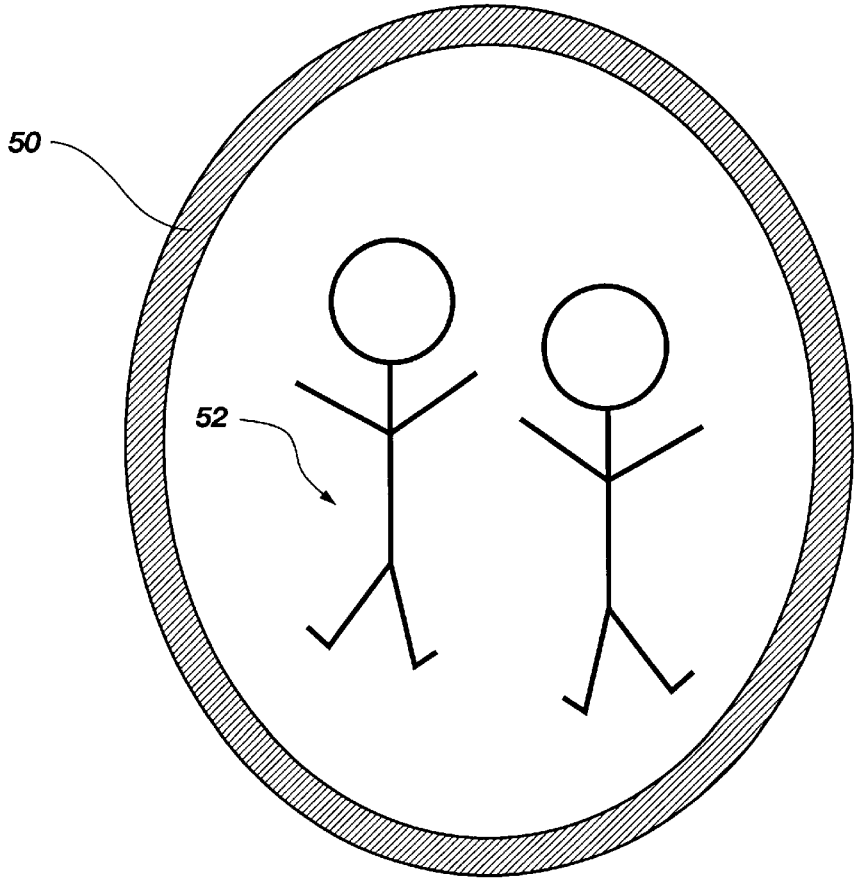
FIG. 9 is graphical illustration of an image surrounded by a shaped frame generated by a template configured according to the invention.

It should be appreciated that the templates shown in FIGS. 2–7 also may be used to cut out frame-like or ring-like objects instead of solid pieces. By way of example, this procedure is explained with reference to FIGS. 4 and 9. With the template 300 mounted on a selected medium 20 as described above, the user proceeds to conduct two cutting operations using two different pairs of the grooves 303A and 303B. More specifically, this is accomplished by first cutting the medium by drawing the cutting blade along a first set of grooves, e.g., the outermost pair of grooves 303A and 303B shown in FIG. 4; and then, without removing the template, cutting the medium by drawing the cutting blade along a second set of grooves, e.g., the pair of grooves 303A and 303B that are immediately adjacent to the outermost grooves. The cuts are made for the full length of each of the grooves in which the cutting blade is inserted. The result is that two pairs of oval shaped incisions are formed in the medium 20, with each end of each incision separated from the adjacent end of the other corresponding incision by an interrupted (i.e., uncut) portion of the medium. Thereafter the user removes the template 300 from the medium 20. Then, preferably with the medium still attached to cutting surface 30, the user makes additional cuts in the medium so as to connect together each pair of incisions corresponding to the outermost cutting grooves and also so as to connect together each the incisions corresponding to the immediately adjacent cutting grooves. Once cutting has been completed, the user will have generated an oval shaped frame or border, such as the frame 50 shown in FIG. 9. The frame 50 may be used to enhance an image 52, as shown.

Also to be recognized is that the templates may be made so that each geometric pattern comprise more than two grooves. For example, the template shown in FIG. 2 may be modified so that each groove 103A and 103B is replaced by two grooves each extending through an arc only slightly less than 90° and separated from one another with webs like webs 104A and 104B, whereby each circle pattern is defined by four grooves of like radius of curvature.

Of course, the templates are not limited to the specific designs shown in the drawings, and other designs obvious to persons skilled in the art may be used in making templates according to this invention. For example, the template may comprise grooves separated by webs as described herein, with the grooves and webs together defining a heart-shaped pattern. It also is contemplated that each template may embody only a single cutting pattern defined by two or more complementary cutting grooves, e.g., a single oval pattern, or more than one pattern, e.g.,, one or more circular patterns surrounded by one or more rectangular patterns. Still other modifications will be obvious to persons skilled in the art.

A primary advantage of the invention is that it permits direct cutting of a pattern in a selected medium, eliminating the need to first trace the pattern on the medium. Another advantage is that the templates are transparent and hence permit viewing of the medium as it is being cut. Still another important advantage of the invention is that a single multi-pattern template is provided for cutting out any one of a plurality of shapes that have a similar configuration but differ from one another in size. Another advantage of the invention is that provides a template with nested cutting patterns of virtually any selected configuration.

The invention is not limited to the above the specific details herein described or illustrated, but encompasses all modifications obvious to persons skilled in the art from the this disclosure that are within the scope of the appended claims.

We claim:

1. A template for cutting a medium with a knife blade comprising:

a flat sheet having a plurality of first grooves each having a first end and a second end and substantially defining a first portion of an enclosed shape and a plurality of second grooves each having a first end and a second end and substantially defining a second portion of an enclosed shape, said plurality of first grooves and said plurality of second grooves coacting to define a plurality of similar enclosed shapes that differ in size and are concentric with one another, with each pair of first and second grooves substantially defining an entire one of said similar enclosed shapes and configured to guide a knife blade for cutting a medium;

each of said first ends of said first grooves being adjacent to a first end of one of said second grooves, with each pair of adjacent first ends of said first and second grooves being separated by a single uninterrupted portion of said sheet, and each of said second ends of said first grooves being adjacent to a second end of one of said second grooves, with each pair of adjacent second ends of said first and second grooves being separated by another single uninterrupted portion of said sheet.

2. The template of claim 1 wherein said single uninterrupted portions of said sheet that separate said first ends of said first and second grooves are linearly aligned with said single uninterrupted portions of said sheet that separate said second ends of said first and second grooves.

3. The template of claim 1, wherein said plurality of similar enclosed shapes are elliptical, hexagonal, or star shapes.

4. The template of claim 1 wherein said sheet has a notch along an edge thereof for locating said template relative to the medium to be cut.

5. The template of claim 1 wherein each of said first and second grooves has a width ranging from 0.015 to 0.018 inch so as to accommodate a knife blade having a thickness ranging from 0.011 to 0.013 inch.

6. A template for use in cutting a material into a desired shape, said template comprising:

a transparent plastic panel having planar first and second sides contiguous with a perimeter of said panel, said panel also having a plurality of channels adapted to receive and maintain a cutting edge for cutting a material; said channels defining a plurality of similar enclosed shapes of different sizes in a nested arrangement, said shapes all having a hexagonal, star or elliptical shape;

each of said channels consisting of two elongate openings each having a first end and a second end, with said elongate openings of each channel being disposed in end-to-end alignment with each other, each of said first ends being adjacent to and spaced from a second end of an adjacent opening of the same channel by a continuous web of said panel having a length that is sufficient to maintain the physical integrity of said panel while minimizing the amount of medium that has to be cut after removal of the template to completely reproduce one of said enclosed shapes.

7. The template of claim 6 wherein said panel has a notch in its perimeter for locating said template relative to the medium.

8. The template of claim 6 wherein said elongate openings have a width ranging from 0.015 to 0.018 inch.

9. A method for cutting a medium according to a pattern of predetermined shape comprising:

providing a template in the form of a flat sheet having planar sides coextensive with a perimeter of the sheet and having a plurality of channels defining a plurality of similar enclosed shapes of different sizes, with smaller size shapes being nested within larger size shapes, said shapes being a hexagon, an ellipse or a star, each channel being defined by a pair of elongate openings formed in said sheet, each elongate opening of each channel being separated from an adjacent elongate opening of the same channel by an uninterrupted web, each end of each elongate opening of each channel being aligned with an end of another opening of said each channel;

positioning said template over a selected medium;

inserting a cutting blade in a first elongate opening of a selected one of said channels so that it is in contact with said medium;

cutting the medium by drawing the cutting blade along substantially the entire length of said first elongate opening so that the blade cuts the medium according to the pattern of said first elongate opening;

inserting the cutting blade in a second elongate opening of said selected channel so that it is in contact with said medium; and cutting the medium by drawing the cutting blade along substantially the entire length of said second elongate opening so that the blade cuts the medium according to the pattern of said second elongate opening, so that portions of the medium lying below the webs separating said elongate openings remain uncut, said elongate openings having a width such that said cutting blade can move along the length of said elongate openings while being restrained against sidewise movement by the side edges of said elongate openings.

10. The method of claim 9 further including providing said channels with a clearance for said cutting blade ranging from 0.002 to 0.007 inch.

11. The method of claim 9, further comprising translating the template a relatively small degree so that said uncut portions of said medium are exposed through said elongate openings of said selected channel, and drawing the cutting blade along said elongate openings so as to cut the uncut portions of said medium.

12. A template for cutting a medium into a selected shape comprising:

a flat sheet; and a plurality of nested channels cut in said flat sheet and substantially defining a plurality of similar enclosed shapes of different sizes nested within one another said, similar shapes being hexagons, rectangles, ellipses or stars; each channel defining substantially the entirety of one of said enclosed shapes but with each channel being separated by first and second uninterrupted portions of said sheet, with each of said channels having a width in the range of 0.015 to 0.018 inch and said uninterrupted portions of said sheet having a length that is sufficient to maintain the physical integrity of said panel while minimizing the amount of medium that has to be cut after removal of the template to completely reproduce one of said enclosed shapes, and a selected number of said first and second uninterrupted portions of said sheet bring linearly aligned with each other and out of linear alignment with others of said first and second uninterrupted portions of said sheet.

* * * * *